US007541940B2

(12) United States Patent
Upton

(10) Patent No.: US 7,541,940 B2
(45) Date of Patent: Jun. 2, 2009

(54) PROXIMITY-BASED TASK ALERTS

(75) Inventor: John Daniel Upton, Georgetown, TX (US)

(73) Assignee: International Business Machines Corporation, Armonk, NY (US)

( * ) Notice: Subject to any disclaimer, the term of this patent is extended or adjusted under 35 U.S.C. 154(b) by 153 days.

(21) Appl. No.: 11/355,647

(22) Filed: Feb. 16, 2006

(65) Prior Publication Data

US 2007/0188319 A1 Aug. 16, 2007

(51) Int. Cl.
*G08B 21/00* (2006.01)

(52) U.S. Cl. ..... 340/686.1; 340/988

(58) Field of Classification Search ..... 340/686.1, 340/988; 705/1, 14, 211, 208
See application file for complete search history.

(56) References Cited

U.S. PATENT DOCUMENTS 6,177,905 B1 1/2001 Welch
2003/0005060 A1 1/2003 Davidson et al.
2003/0225589 A1* 12/2003 Eaton et al. ..... 705/1
2004/0260458 A1* 12/2004 Park et al. ..... 701/200

OTHER PUBLICATIONS

Devitt et al., "Topographical Proximity for Mining Network Alarm Data", SIGCOMM'05 Workshops, Aug. 2005, Philadelphia USA, ACM 1-59593-026-4/05/0008, pp. 179-184.
Simon et al., "Sensor Network-Based Contersniper System", SenSys'04, Nov. 2004, Baltimore USA, ACM 1-58113-879-2/04/0011, pp. 1-12.

* cited by examiner

*Primary Examiner*—Daniel Wu
*Assistant Examiner*—Shirley Lu
(74) *Attorney, Agent, or Firm*—Yee & Associates, P.C.; Libby Z. Handelsman

(57) ABSTRACT

A computer implemented method, apparatus, and computer usable program code to generate proximity-based task alerts in a mobile computing device. A geographic location is linked to a set of tasks in a task list. A user selects a proximity to the geographic location for the alarm to form a selected proximity. A determination is made as to whether the mobile computing device is within the selected proximity. A proximity task-reminder alarm is triggered in response to making a determination that the mobile computing device is within the selected proximity.

3 Claims, 8 Drawing Sheets

PROXIMITY-BASED TASK ALERTS

BACKGROUND OF THE INVENTION

1. Field of the Invention

The present invention relates generally to an improved data processing system and in particular, to a method, apparatus, and computer program product for providing task alerts. Still more particularly, the present invention relates to a computer implemented method, apparatus, and computer program product for generating proximity-based task alerts in a mobile computing device.

2. Description of the Related Art

Many mobile computing devices now have global positioning system (GPS) receivers to enable global positioning system navigation. Global positioning system enabled mobile computing devices include, for example, cellular phones, tablet computers, and personal digital assistants (PDAs), such as Palm OS®, Windows Mobile® Pocket PC, and BlackBerry®. Among the software functions most often included in these devices are task lists and appointment calendars.

A task list permits a user to enter a list of tasks or things to do. Typically, an alarm or alert can be set to sound at a particular time as a reminder to the user to perform the specified task.

An appointment calendar permits a user to set an appointment or event based upon a particular date on a calendar. An alarm or alert can be set to sound at a particular date and/or time as a reminder to the user of the appointment or event. Mobile computing devices utilize these features to organize personal information by permitting users to make notes, store information, track appointments, and receive appointment reminders in a device that is portable, convenient, and easy to use.

Many devices also provide a global positioning system permitting a user to enter a destination and/or one or more intermediate way-points. The global positioning system navigation provides directions to the destination and way-points en route to the destination. In addition, the navigation may also issue a way-point alert as a reminder of where to turn and/or change directions in accordance with the directions provided by the navigation.

Manufacturers have also combined mobile computing devices with multimedia functions in order to expand on the functionality of mobile computing devices. For example, mobile computing devices can include digital camera features, e-mail capabilities, MP3 players, video players, and even web support. Mobile computing devices with these added features provide additional convenience and functionality to users.

SUMMARY OF THE INVENTION

The aspects of the present invention provide a computer implemented method, apparatus, and computer program product to generate proximity-based task alerts in a mobile computing device. A geographic location is linked to a set of tasks in a task list. A user selects a proximity to the geographic location for the alarm to form a selected proximity. A determination is made as to whether the mobile computing device is within the proximity. A proximity task-reminder alarm is triggered in response to making a determination that the mobile computing device is within the selected proximity.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

With reference now to the figures and in particular with reference to FIGS. 1-6, exemplary diagrams of data processing environments are provided in which embodiments of the present invention may be implemented. It should be appreciated that FIGS. 1-6 are only exemplary and are not intended to assert or imply any limitation with regard to the environments in which aspects or embodiments of the present invention may be implemented. Many modifications to the depicted environments may be made without departing from the spirit and scope of the present invention.

Figure 1:
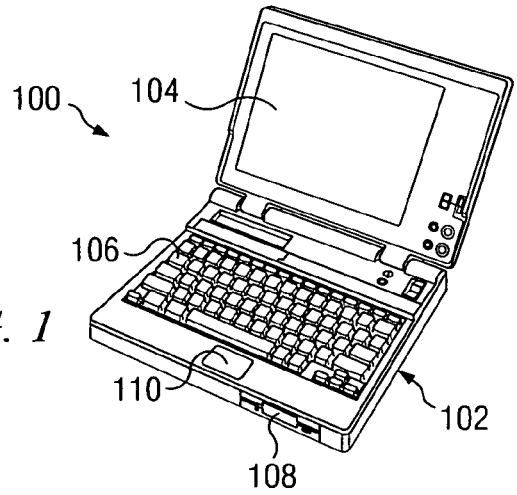
FIG. 1 is a pictorial representation of a data processing system in which the present invention may be implemented in accordance with an exemplary embodiment of the present invention.

With reference now to FIG. 1, a pictorial representation of a data processing system in which the present invention may be implemented is depicted in accordance with a preferred embodiment of the present invention. A mobile computer 100 is depicted which includes system unit 102, video display terminal 104, keyboard 106, storage devices 108, which may include floppy drives and other types of permanent and removable storage media, and pointer device 110. Additional input devices may be included with mobile computer 100, such as, for example, a mouse, joystick, touch screen, trackball, microphone, and the like. Mobile computer 100 may be implemented using any suitable computer, such as an IBM Thinkpad computer, which is a product of International Business Machines Corporation, located in Armonk, N.Y. Mobile computer 100 also preferably includes a graphical user interface (GUI) that may be implemented by means of systems software residing in computer readable media in operation within computer 100.

In accordance with the aspects of the present invention, mobile computer 100 can include a laptop computer, a tablet computer, a cellular telephone, a personal digital assistant (also known as PDAs or palmtops), a personal navigator, and any other known or available mobile computing device.

Figure 2:
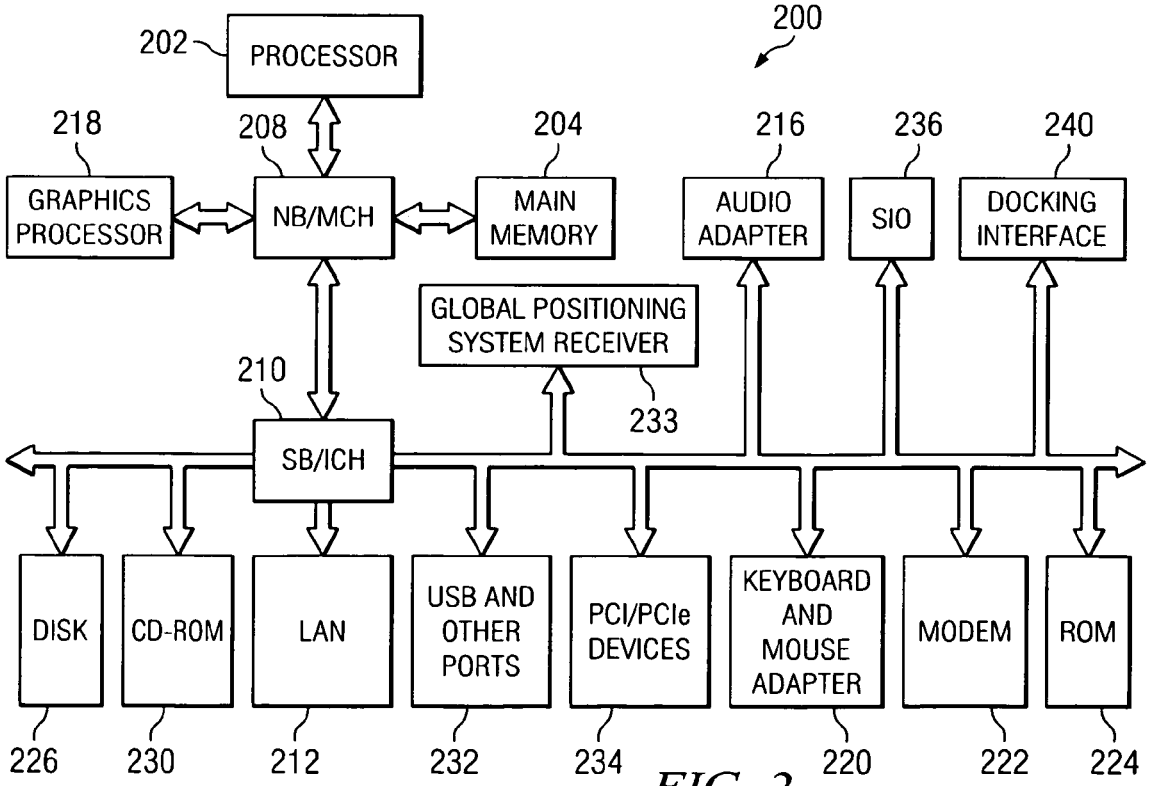
FIG. 2 is a block diagram of a data processing system in which the present invention may be implemented in accordance with an exemplary embodiment of the present invention.

With reference now to FIG. 2, a block diagram of a data processing system is shown in which the present invention may be implemented. Data processing system 200 is an example of a mobile computer, such as mobile computer 100 in FIG. 1, in which code or instructions implementing the processes of the present invention may be located. In the depicted example, data processing system 200 employs a hub architecture including a north bridge and memory controller hub (MCH) 208 and a south bridge and input/output (I/O) controller hub (ICH) 210. Processor 202, main memory 204, and graphics processor 218 are connected to MCH 208. Graphics processor 218 may be connected to the MCH through an accelerated graphics port (AGP), for example.

In the depicted example, local area network (LAN) adapter 212, audio adapter 216, keyboard and mouse adapter 220, modem 222, read only memory (ROM) 224, hard disk drive (HDD) 226, CD-ROM drive 230, universal serial bus (USB) ports and other communications ports 232, a global positioning system (GPS) receiver 233, and PCI/PCIe devices 234 may be connected to ICH 210.

PCI/PCIe devices may include, for example, Ethernet adapters, add-in cards, PC cards for notebook computers, etc. PCI may use a cardbus controller, while PCIe does not. ROM 224 may be, for example, a flash binary input/output system (BIOS). Hard disk drive 226 and CD-ROM drive 230 may use, for example, an integrated drive electronics (IDE) or serial advanced technology attachment (SATA) interface. A super I/O (SIO) device 236 may be connected to ICH 210.

Global positioning system receiver 233 receives data from various satellites. Global positioning system receiver 233 determines the latitude and longitude of global positioning system receiver 233 based upon the difference in time of reception for signals received from different global positioning system satellites.

Data processing system 200 may be a mobile computing device, such as a laptop computer or hand held computer, such as a personal digital assistant, cellular telephone, or tablet computer. Docking interface 240 may also be connected to the ICH 210. Docking interface 240 provides port replication to allow the data processing system to easily connect to a keyboard, pointing device, monitor, printer, speakers, etc. The docking interface allows the mobile computing device to operate as a desktop computer with the more immobile peripheral devices.

An operating system runs on processor 202 and is used to coordinate and provide control of various components within data processing system 200 in FIG. 2. The operating system may be a commercially available operating system such as Windows XP, which is available from Microsoft Corporation. An object oriented programming system such as Java® may run in conjunction with the operating system and provides calls to the operating system from Java® programs or applications executing on data processing system 200. "Java" is a trademark of Sun Microsystems, Inc. Instructions for the operating system, the object-oriented programming system, and applications or programs are located on storage devices, such as hard disk drive 226, and may be loaded into main memory 204 for execution by processor 202. The processes of the present invention are performed by processor 202 using computer implemented instructions, which may be located in a memory such as, for example, main memory 204, flash BIOS memory 224, or in one or more peripheral devices 226 and 230.

Those of ordinary skill in the art will appreciate that the hardware in FIG. 2 may vary depending upon the implementation. Other internal hardware or peripheral devices, such as flash memory, equivalent nonvolatile memory, or optical disk drives and the like, may be used in addition to or in place of the hardware depicted in FIG. 2. Also, the processes of the present invention may be applied to a multiprocessor data processing system.

For example, data processing system 200 may be a personal digital assistant (PDA), which is configured with flash memory to provide non-volatile memory for storing operating system files and/or user-generated data. The depicted example in FIG. 2 and above-described examples are not meant to imply architectural limitations. For example, data processing system 200 also may be a tablet computer, personal navigation device, or telephone device in addition to taking the form of a PDA.

Figure 3:
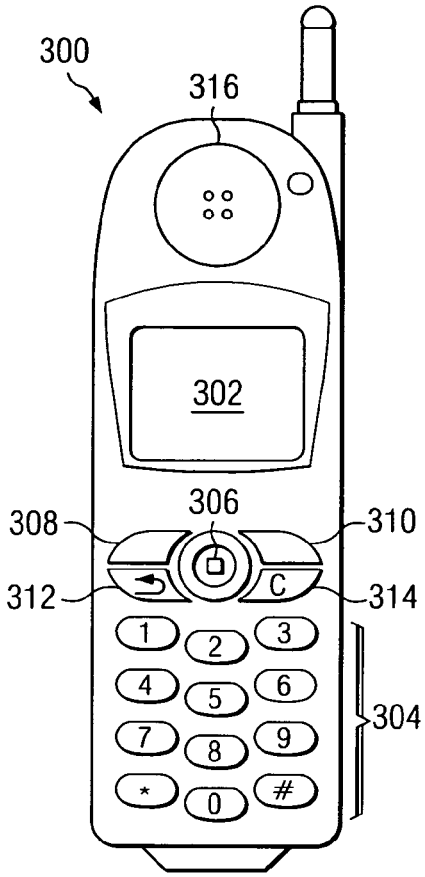
FIG. 3 depicts a mobile telephone in which the present invention may be implemented in accordance with an exemplary embodiment of the present invention.

With reference now to FIG. 3, a mobile telephone is depicted in which the present invention may be implemented. Mobile phone 300 includes screen 302, which is capable of displaying pictures and text. Additionally, mobile phone 300 also includes numeric keypad 304, joystick 306, and buttons 308, 310, 312, and 314 placed around the joystick 306. These buttons are used to initiate various functions in mobile phone 300. These functions include, for example, activating a menu, displaying a calendar or task list, or initiating a call. Mobile phone 300 can also include camera 316, which may be used to take pictures or videos depending upon the implementation.

In addition, mobile phone 300 includes a global positioning system receiver for determining a position of mobile phone 300 on the Earth's surface by comparing data received from various satellites by the global positioning system receiver.

Figure 4:
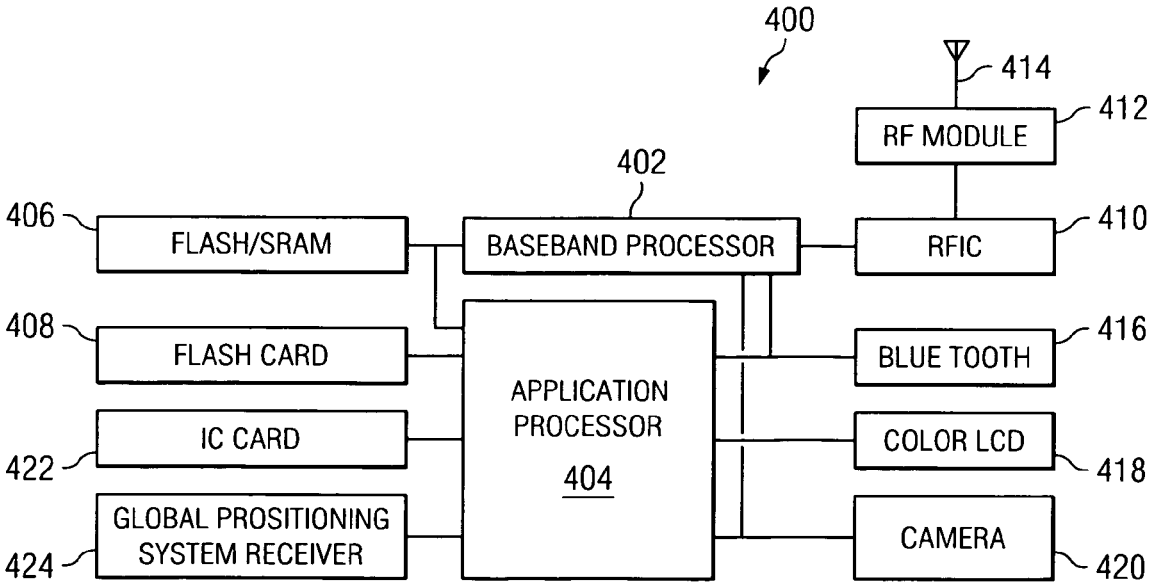
FIG. 4 is a block diagram of a camera phone in which the present invention may be implemented in accordance with an exemplary embodiment of the present invention.

With reference now to FIG. 4, a block diagram of a camera phone is depicted in accordance with a preferred embodiment of the present invention. Camera phone 400 includes baseband processor 402, application processor 404, flash/static random access memory (SRAM) 406, flash card 408, radio frequency integrated circuit (RFIC) 410, radio frequency (RF) module 412, antenna 414, Blue Tooth unit 416, color liquid crystal display (LCD) 418, camera 420, IC card 422, and global positioning system receiver 424.

Baseband processor 402 provides for receiver and transmitter operations and is also referred to as a transceiver. In particular, baseband processor 402 handles all audio, signal, and data processing needed to receive and send data using RF transmissions or Blue Tooth transmissions. Application processor 404 provides the processing power for other functions within camera phone 400. For example, calculators, calendars, alarms, camera functions, and directories are provided through application processor 404. Flash/SRAM 406 is a storage device in which various instructions for providing the functions within camera phone 400 are located and provide upgrades. Flash card 408 is a storage device in which user data and applications may be stored. An example of flash card 408 is a secure digital card.

A pathway for the transmission of voice and other types of data is through RFIC 410. Additionally, short range transmissions may be sent or received through Blue Tooth unit 416. Blue Tooth unit 416 conforms to Blue Tooth wireless specification, which defines the link layer and the application layer for product developers. Both of these transmissions are made through antenna 414 in this illustrative example.

Color LCD 418 provides a display for pictures and other data for camera phone 400. Camera 420, in this example, is a complementary metal oxide semiconductor (CMOS) camera which may be built into camera phone 400 or connected to camera phone 400 as a module, such as IC card 422. IC card 422 also may contain other application specific functions, such as a modem or additional memory.

Global positioning system receiver 424 receives data from various satellites. Global positioning system receiver 424 determines the latitude and longitude of global positioning system receiver 424 by calculating the time taken for each satellite signal to reach global positioning system receiver 424. Based on the difference in time of reception for signals received from different satellites, global positioning system receiver 424 is able to determine the position of global positioning system receiver 424.

Figure 5:
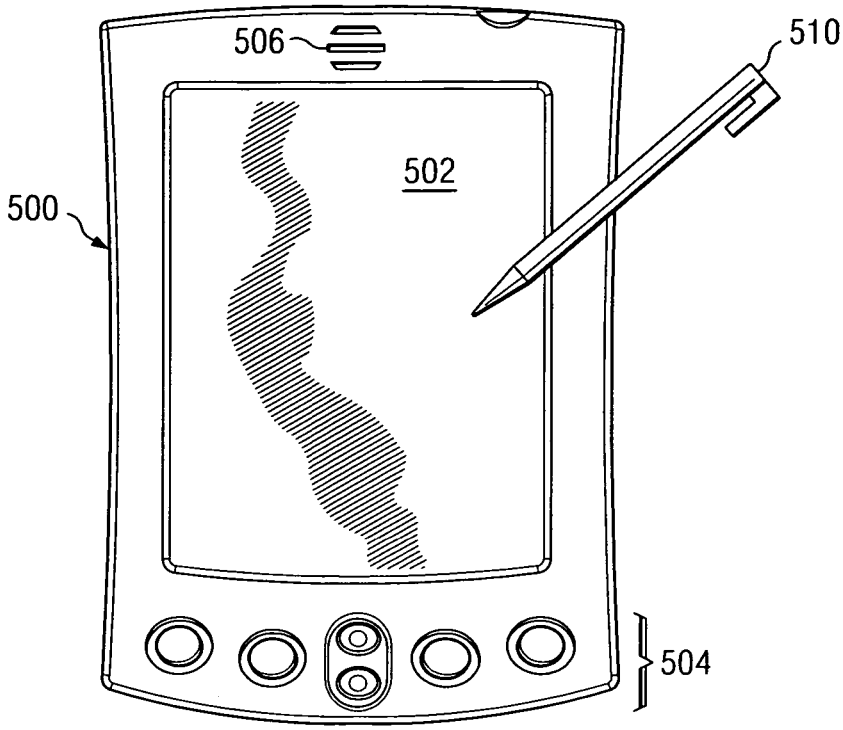
FIG. 5 is a diagram of a client in the form of a personal digital assistant in which the present invention may be implemented in accordance with an exemplary embodiment of the present invention.

With reference now to FIG. 5, a diagram of a client in the form of a personal digital assistant (PDA) is depicted in accordance with a preferred embodiment of the present invention. PDA 500 includes a display 502 for presenting textual and graphical information. Display 502 may be a known display device, such as a liquid crystal display (LCD) device. The display may be used to present a map or directions, calendar information, a telephone directory, or an electronic mail message. In these examples, screen 502 may receive user input using an input device such as, for example, stylus 510.

PDA 500 may also include keypad 504 and speaker 506. PDA 500 may also include an antenna that is internal to PDA 500. Keypad 504 may be used to receive user input in addition to using screen 502. Speaker 506 provides a mechanism for audio output, such as presentation of an audio file. The internal antenna provides a mechanism used in establishing a wireless communications link between PDA 500 and a network and/or global positioning system satellites. PDA 500 also preferably includes a graphical user interface that may be implemented by means of systems software residing in computer readable media in operation within PDA 500.

Figure 6:
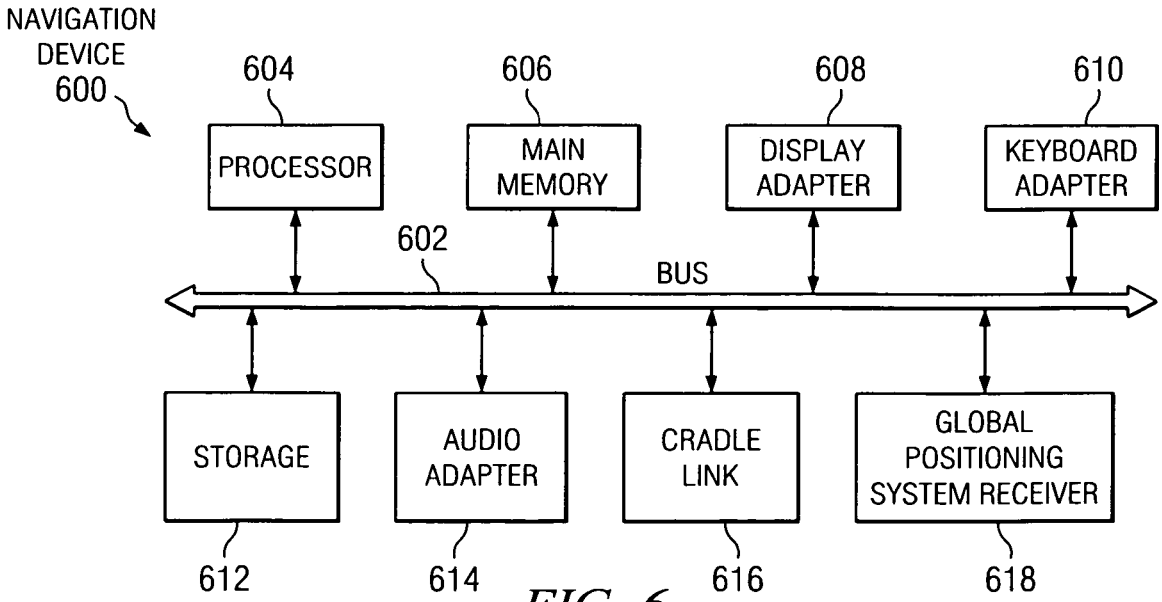
FIG. 6 a block diagram of a personal digital assistant in which the present invention may be implemented in accordance with an exemplary embodiment of the present invention.

Turning now to FIG. 6, a block diagram of a PDA is shown in accordance with a preferred embodiment of the present invention. PDA 600 is an example of a PDA, such as PDA 500 in FIG. 5, in which code or instructions implementing the processes of the present invention may be located. PDA 600 includes a bus 602 to which processor 604 and main memory 606 are connected. Display adapter 608, keypad adapter 610, storage 612, audio adapter 614, and global positioning system receiver 618 also are connected to bus 602. Cradle link 616 provides a mechanism to connect PDA 600 to a cradle used in synchronizing data in PDA 600 with another data processing system. Further, display adapter 608 also includes a mechanism to receive user input from a stylus when a touch screen display is employed.

Global positioning system receiver 618 receives signals from various satellites. Global positioning system receiver 618 determines the latitude and longitude of receiver 618 based upon the difference in time of reception of the signals from the different satellites.

An operating system runs on processor 604 and is used to coordinate and provide control of various components within PDA 600 in FIG. 6. The operating system may be, for example, a commercially available operating system such as Windows CE, which is available from Microsoft Corporation. Instructions for the operating system and applications or programs are located on storage devices, such as storage 612, and may be loaded into main memory 606 for execution by processor 604.

Those of ordinary skill in the art will appreciate that the hardware in FIG. 6 may vary depending upon the implementation. Other internal hardware or peripheral devices, such as flash ROM (or equivalent nonvolatile memory) or optical disk drives and the like, may be used in addition to or in place of the hardware depicted in FIG. 6.

A mobile computing device is a computing device that is compact enough to be held in one or two human hands. For example, a mobile computing device includes cellular phones, tablet computers, smart watches, personal navigation devices, and personal digital assistants, also known as PDAs and palmtops. Mobile computing devices typically provide task list/to-do list functions. For example, mobile computing devices commonly permit a user to enter a task into a list of tasks or a to-do list and associate that task with a specified date and/or time. When the specified date and/or time is reached, an alarm or alert is triggered to remind the user to perform the task. Mobile computing devices also frequently permit a user to enter an appointment or event along with a date and/or time in a calendar feature. Upon reaching the specified date and/or time, an alert or alarm may be triggered to remind the user of the appointment or event.

The aspects of the present invention recognize that currently available mobile computing devices do not provide an ability to enter a task in a task list along with a place, destination, or other location as an alarm trigger, rather than a date and/or time alarm trigger. Furthermore, current global positioning system navigation enabled devices do not permit a user to link a task in a list of tasks to a location trigger in order to receive a reminder regarding a task associated with a particular place, destination, way-point, or other location.

A location trigger is a place or location that acts as a trigger for a task-reminder alarm. A location trigger can be any place, destination, way-point, or other location selected by a user. Likewise, a date/time trigger is any date and/or time that acts as a trigger for issuance of a task-reminder alarm. For example, a location trigger for a task to "pick up dry cleaning" could be "dry cleaning store" and the date/time trigger could be "12:30 p.m." As used herein, the term "way-point" refers to a place or location that is near a destination or en route to the destination. For example, a way-point could include, but is not limited to, gas stations, rest-stop facilities, lodgings, and/or any other location near or along a route to a particular destination.

The ability to link a task within a task list to a location trigger enables a user to receive a reminder to perform a task associated with a particular location when the user is within the proximity or vicinity of that location. For example, if a user needs to pick up a prescription at the pharmacy on the way home from work on Friday, it would be convenient to link the task "pick up prescription" to the "pharmacy" location. In such a case, the mobile computing device would not only issue a task-reminder alarm to pick up the prescription on Friday, but the device would also issue the reminder on Friday when the user is within a selected proximity or distance from the pharmacy. This proximity-based reminder reduces the likelihood that the user, having received a task-reminder earlier in the day, would nevertheless forget to stop at the pharmacy when the user was actually within the vicinity of the pharmacy.

Currently, many mobile computing devices are enabled for global positioning navigation. Global positioning system navigation in mobile computing devices enables a user to enter a destination and one or more intermediate way-points. The global positioning system navigation provides a user with directions to a particular destination. In addition, global positioning system navigation can also issue destination or way-point alerts as reminders of where to turn in accordance with directions to a particular destination.

However, global positioning navigation does not currently permit a user to link a task to destinations and/or way points. Furthermore, currently available mobile computing devices and global positioning system navigation does not permit a user to select a particular location as an alarm trigger to remind a user to perform one or more tasks associated with the particular location.

The aspects of the present invention provide a computer implemented method, apparatus, and computer usable program code to generate proximity-based task alerts in a mobile computing device. A location alarm trigger is added to a task list function of a mobile computing device. As used herein, the term "mobile computing device" includes cellular phones, tablet computers, mobile computing devices, personal digital assistants, personal navigation devices, and any other device shown in FIGS. 1-6 above.

Figure 7:
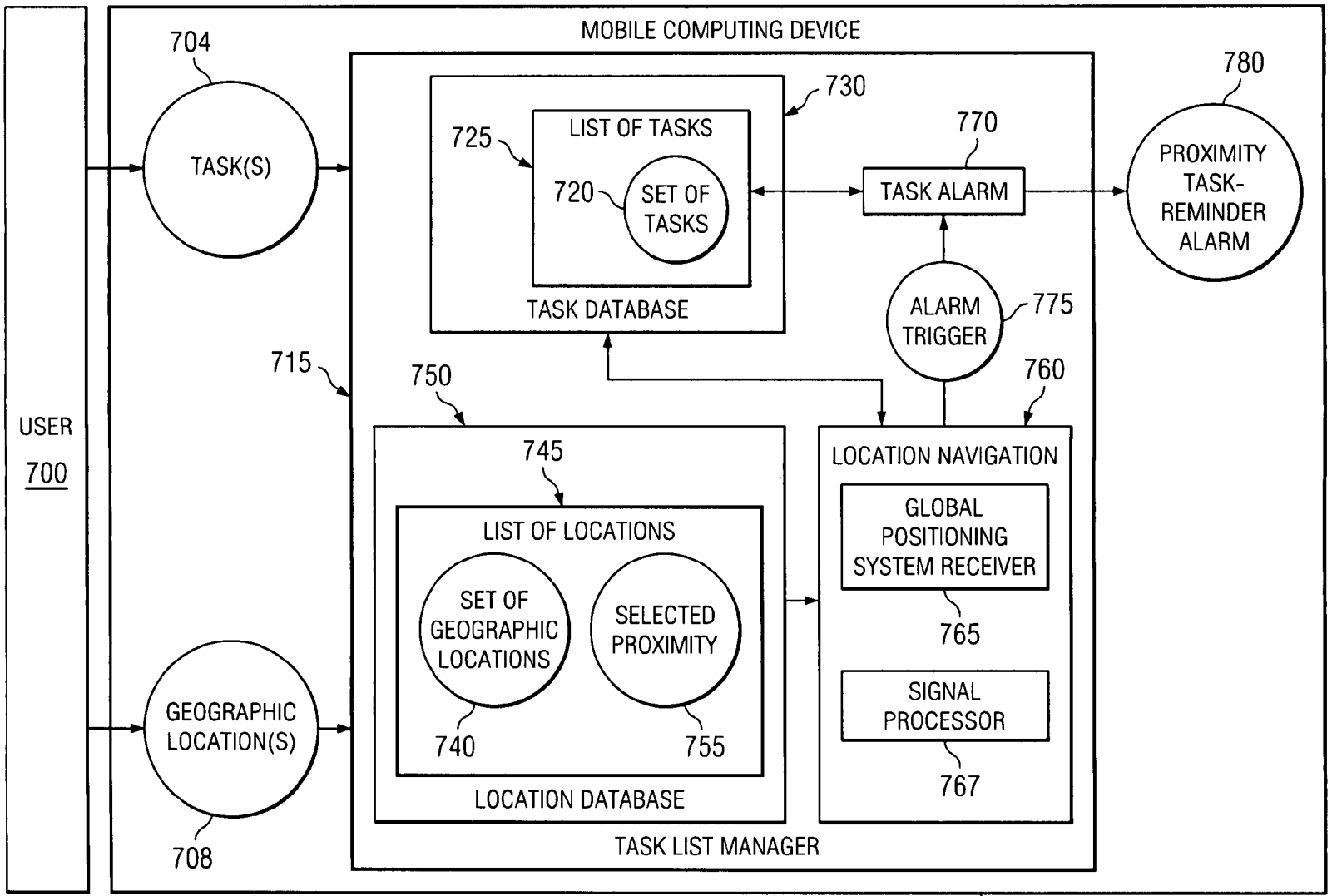
FIG. 7 is an exemplary block diagram illustrating data flow in a process for generating a proximity task-reminder alarm in a mobile computing device in accordance with an exemplary embodiment of the present invention.

FIG. 7 is an exemplary block diagram illustrating data flow in a process for generating a proximity task-reminder alarm in a mobile computing device in accordance with an exemplary embodiment of the present invention. A user 700 utilizes a mobile computing device, such as mobile computing device 710 to generate a proximity task-reminder alarm based on a location of mobile computing device 710. Mobile computing device 710 can be any computing device described in FIGS. 1-6 above.

User 700 enters one or more items or tasks, such as task(s) 704 and one or more geographic locations, such as geographic location(s) 708, into mobile computing device 710 task list manager 715. Task list manager 715 functions to associate task(s) 704 with geographic location(s) 708 to generate a location based alarm that will trigger a reminder to user 700 to perform task(s) 704 when user is at or near geographic location(s) 708, as opposed to a time-based alarm in which a reminder is only generated when a particular time has arrived.

Task list manager 715 stores task(s) 704 as set of tasks 720. Set of tasks 720 is stored in list of tasks 725 in task database 730 for later retrieval by task list manager 715. As used herein, the term "set of tasks" comprises a single task, one or more related tasks, or one or more unrelated tasks.

In these examples, user 700 also enters one or more geographic location(s) 708. Task list manager 715 stores geographic location(s) 708 as set of geographic locations 740. Set of geographic locations 740 is stored in list of locations 745 in location database 750 of mobile computing device 710. As used herein, a set of geographic locations refers to a single geographic location or multiple geographic locations. In this example, user 700 also enters a selected proximity of the geographic location to form selected proximity 755 associated with set of geographic locations 740.

Selected proximity 755 is a specified distance from one or more geographic locations in set of geographic locations 740 associated with one or more tasks in set of tasks 720. A user can be prompted to enter selected proximity 755 when user 700 enters a selected geographic location or locations as a location trigger for proximity task-reminder alarm 780. Selected proximity 755 is stored in list of locations 745 in association with set of geographic locations 740 in location database 750.

In the alternative, user 700 can set a user-defined default proximity. For example, a user can select 1.5 miles as the default proximity. In such a case, if a user does not enter a selected proximity for a particular task or particular geographic location, the user-defined default proximity is utilized as selected proximity 755. Thus, when location navigation 760 determines that mobile computing device 710 is within 1.5 miles of one or more geographic locations in set of geographic locations 740 linked to set of tasks 720, location navigation sends alarm trigger 775 to task alarm 770. In response to receiving alarm trigger 775, task alarm 770 issues proximity task-reminder alarm 780. Alarm trigger 775 is a location alarm trigger. A location alarm trigger initiates issuance of proximity task-reminder alarm 780 based on a location of mobile computing device 710.

Figure 10:
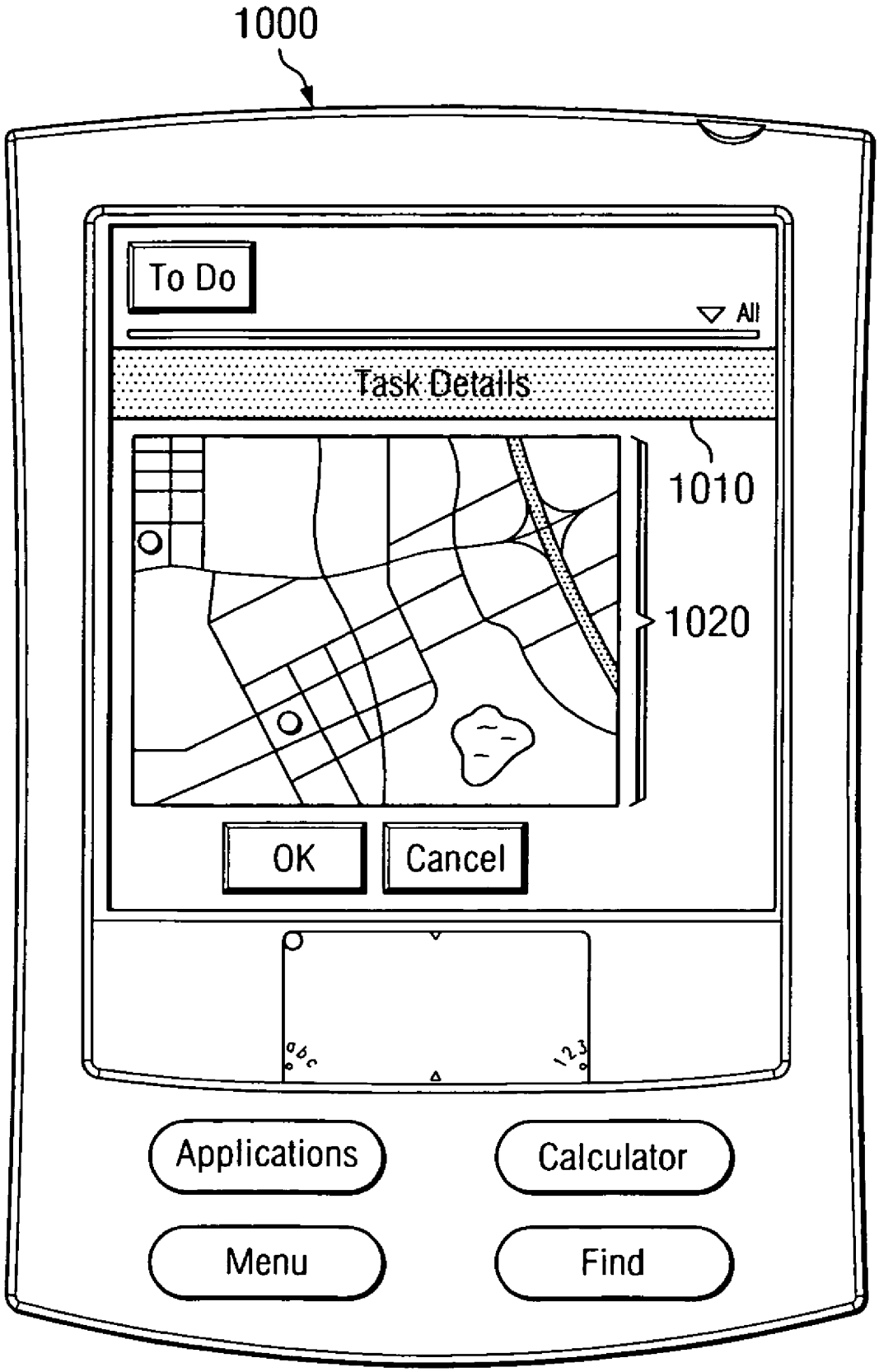
FIG. 10 is an exemplary block diagram illustrating an interface for a mobile computing device when a new geographic location is selected by a user utilizing a navigation mapping feature in accordance with an exemplary embodiment of the present invention.

Location navigation 760 provides a location mapping function that enables a user to select a new geographic location not previously stored in location database 750 by selecting the new location on a map provided by location navigation 760. An illustrative example of a location mapping function is depicted in FIG. 10.

Location navigation 760 links set of geographic locations 740 with set of tasks 720. In accordance with this illustrative example, each task in list of tasks 725 has a unique task identifier associated with that particular task. Likewise, each geographic location in list of geographic locations 745 has a unique location identifier associated with that particular geographic location.

When a new task, such as task(s) 704, is added to list of tasks 725, a location identifier for the geographic location selected by user 700 for the particular task, such as geographic location(s) 708, is associated with the task. Thus, each task in list of tasks 725 is associated with a location identifier for the geographic location or set of geographic locations selected by the user as a location trigger for a task-reminder alarm. In the alternative, each geographic location in set of geographic locations can be associated with a task identifier for the task associated with the particular geographic location. In this example, user 700 selects set of geographic locations 740 as a location trigger for set of tasks 720. Thus, set of tasks is associated with a location identifier for set of geographic locations 740.

Location navigation 760 also determines when user 700 is within selected proximity 755 of one or more selected geographic locations in set of geographic locations 740. Location navigation 760 is a global positioning system enabled component that is capable of determining the location of mobile computing device 710. Location navigation 760 includes a global positioning system receiver 765 for receiving signals from global positioning system satellites.

Global positioning system receiver 765 includes signal processor 767. Signal processor 767 processes global positioning system satellite signals to determine a location for global positioning system receiver 765. Signal processor 767 can be a digital signal processing (DSP) or an application specific integrated circuit (ASIC). Signal processor 767 utilizes signals received from global positioning system satellites to determine the latitude and longitude of mobile computing device 710. In this illustrative example, signal processor is a separate component from global positioning system receiver 765. In an alternative embodiment, signal processor 767 and global positioning system receiver 765 can be embodied within a single component.

A location based task-reminder alarm is triggered when mobile computing device 710 is within selected proximity 755 of any one geographic location in set of geographic locations 740. In this manner, one or more tasks in set of tasks 720 can be linked to a single location or multiple locations in set of geographic locations 740. When mobile computing device 710 comes within selected proximity 755 of any one of the linked geographic locations in set of geographic locations 740, proximity task-reminder alarm 780 is generated by task alarm 770 to remind user 700 of each task in set of tasks 720 linked with set of geographic locations 740.

Location navigation 760 determines whether mobile computing device 710 is within selected proximity 755 of set of geographic locations 740 based upon information provided to location navigation 760 by global positioning system receiver 765. Location navigation 760 periodically compares the location of mobile computing device 710, as calculated by global positioning system receiver 765, to each entry in set of geographic locations 740 using selected proximity 755 as a determination criteria. When location navigation 760 determines that mobile computing device 710 is within selected proximity 755 of set of geographic locations 740, location navigation 760 sends alarm trigger 775 signal to task alarm 770. Task alarm 770 generates proximity task-reminder alarm 780 reminding user 700 of set of tasks 720 associated with geographic location 740.

Proximity task-reminder alarm 780 is presented as any type of available alarm or alert type, including, but not limited to a graphic alarm, a sound alarm, a vibration alarm, a flashing visual alarm, or any combination of these alarm types. For example, upon receiving alarm trigger 770, task alarm 775 could generate proximity task-reminder alarm 780 by emitting a beeping sound in addition to a flashing LED display presenting set of tasks 720 on a display of mobile computing device 710. In accordance with this exemplary illustration, mobile computing device 710 presents set of tasks 720 associated with geographic location 740 to user 700 via a display when proximity task-reminder alarm 780 is issued by task alarm 770.

After proximity task-reminder alarm 780 has issued, user 700 can indicate completion of the task(s) associated with a particular geographic location by canceling proximity task-reminder alarm 780. In the alternative, user 700 can reset proximity task-reminder alarm 780 in order to receive another task-reminder alarm when user 700 is again within selected proximity 755 of one or more geographic locations within set of geographic locations 740.

In accordance with an illustrative embodiment of the present invention, selected proximity 755 can be a pre-defined default proximity value, rather than a user-defined value. A pre-defined default proximity value is utilized by location navigation 760 when user 700 fails to choose a selected proximity for set of geographic locations 740. For example, a pre-defined default proximity of two (2) miles can be set in location navigation. In such a case, when location navigation 760 determines that a user-defined selected proximity has not been set for selected proximity 755, and further determines that mobile computing device 710 is within the pre-defined default proximity of any geographic location linked to a task or set of tasks 720, location navigation 760 sends an alarm trigger 775 signal to task alarm 770 to generate a proximity task-reminder alarm 780.

In another exemplary embodiment of the present invention, a pre-defined default proximity is only used as the selected proximity if a user fails to set a user-defined selected proximity and also fails to set a user-defined default proximity. In such a case, location navigation 760 determines whether a user-defined selected proximity has been chosen. If a user-defined selected proximity has not been chosen, location navigation 760 determines whether a user-defined default proximity has been set. If user 700 has failed to specify a selected proximity and has also failed to specify a default proximity, location navigation 760 utilizes the pre-defined proximity for selected proximity 755.

In accordance with another exemplary illustration of the present invention, a unique task identifier can be associated with every task within set of tasks 720 rather than associating a task identifier with only a single task in list of tasks 725. In such a case, a location identifier for a particular geographic location associated with a set of tasks identifies a single geographic location as a location based trigger for every task in the set of tasks. When user 700 is within selected proximity 755 of the geographic location represented by location identifier, alarm trigger is sent to trigger proximity task-reminder alarm 780 as to every task in set of tasks 720 rather than only generating an alarm as to a single task.

Likewise, a location identifier for set of geographic locations 740 can be associated with a single task or an entire set of tasks in list of tasks 725. In this example, a single location identifier representing two or more geographic locations is associated with a single task or a set of tasks in the list of tasks. Thus, when the user is within selected proximity 755 of any one of the locations in set of geographic locations 740, alarm trigger 775 will be generated.

In accordance with another embodiment of the present invention, a new task can be linked to an existing set of tasks, such as set of tasks 720, for a specified geographic location, such as geographic location(s) 708. For example, if a user has selected a set of tasks including a task "mail bill payments" and linked this task to a location for a post office, the user can add a new task, such as "buy stamps" and link this new task to the existing set of tasks containing the task "mail bill payments." Thus, when the user is within selected proximity 755 to the post office, a proximity task-reminder alarm triggers to issue an alarm and display the set of tasks associated with the post office, including the old task "mail bill payments," as well as the new task "buy stamps."

In accordance with an exemplary embodiment of the present invention, location database 750 and location navigation 760 can be embodied within a single component. In such a case, location navigation 760 comprises location database 750, which stores geographic locations, such as set of geographic locations 740.

Figure 8:
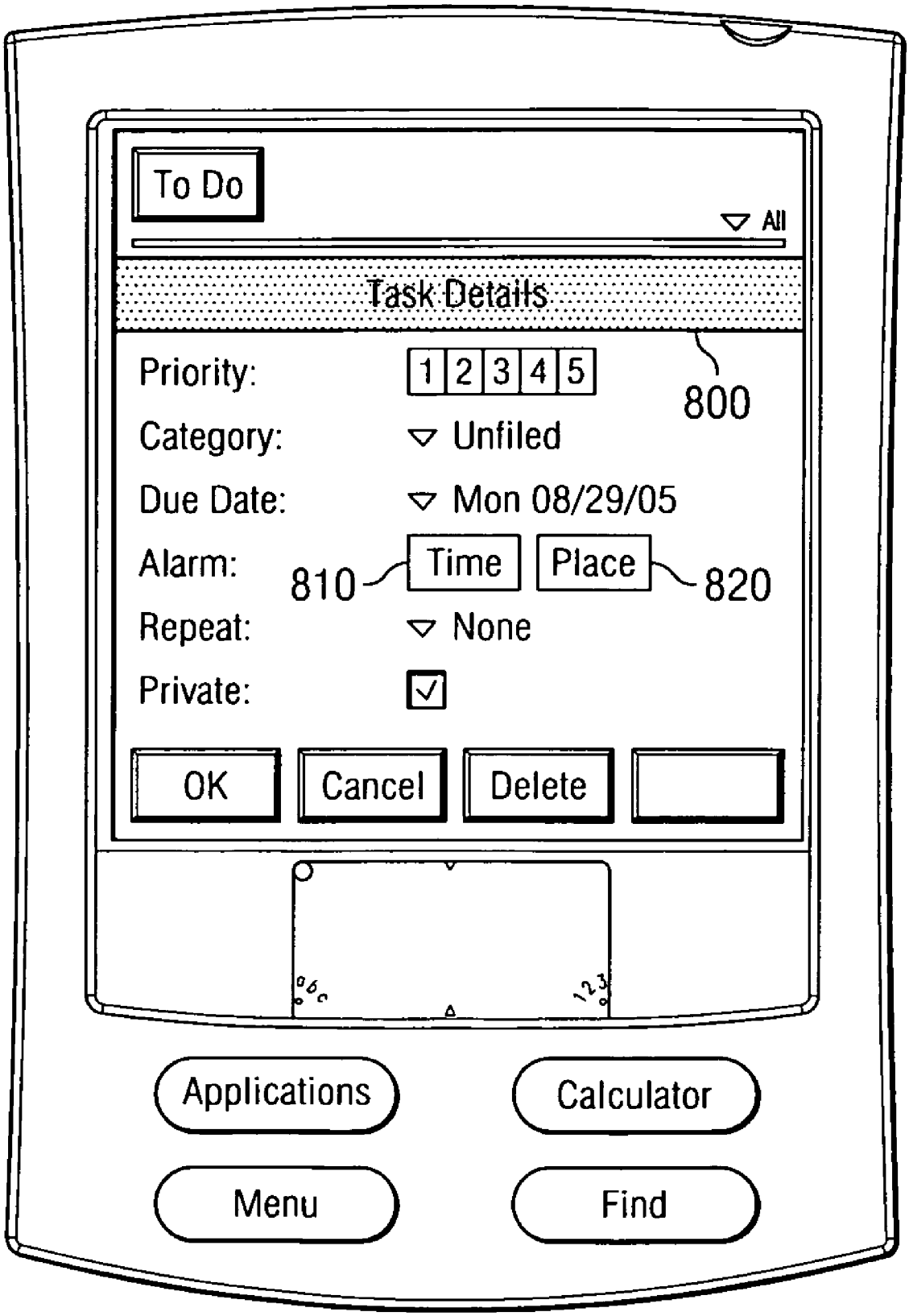
FIG. 8 is an exemplary block diagram illustrating an interface for a mobile computing device when a proximity-based alarm trigger to the task list function of a mobile computing device is selected in accordance with an exemplary embodiment of the present invention.

FIG. 8 is a diagram illustrating an interface for a mobile computing device when a proximity-based alarm trigger to the task list function of a mobile computing device is selected in accordance with an exemplary embodiment of the present invention. Interface 800 may be displayed on a mobile computing device such as mobile computing device 710 in FIG. 7.

When a new task is entered on interface 800, two alarm type options are presented. The first alarm type is a time alarm which may be selected by selecting "Time" button 810. This field is the usual time-based alarm. The time-based alarm triggers at a particular date and/or time to remind the user to perform the task associated with the specified date and/or time. For example, a time-based alarm might be utilized to pay a recurring monthly bill. Time-based alarm 810 can be selected to generate a reminder to the user to send payment in for bills coming due within a few days.

In accordance with the aspects of the present invention, the second alarm type is a proximity-based alarm. A user may select to enter a geographic location as a location based trigger for a task-reminder alarm. In this illustrative example, a user can select a proximity-based alarm by selecting "Place" button 820. "Place" button 820 for selecting a proximity-based alert field permits a user to choose to link a task or set of tasks to one or more geographic locations, such as geographic location(s) 708 within the set of geographic locations 740 in FIG. 7, rather than to a date and/or time.

Figure 9:
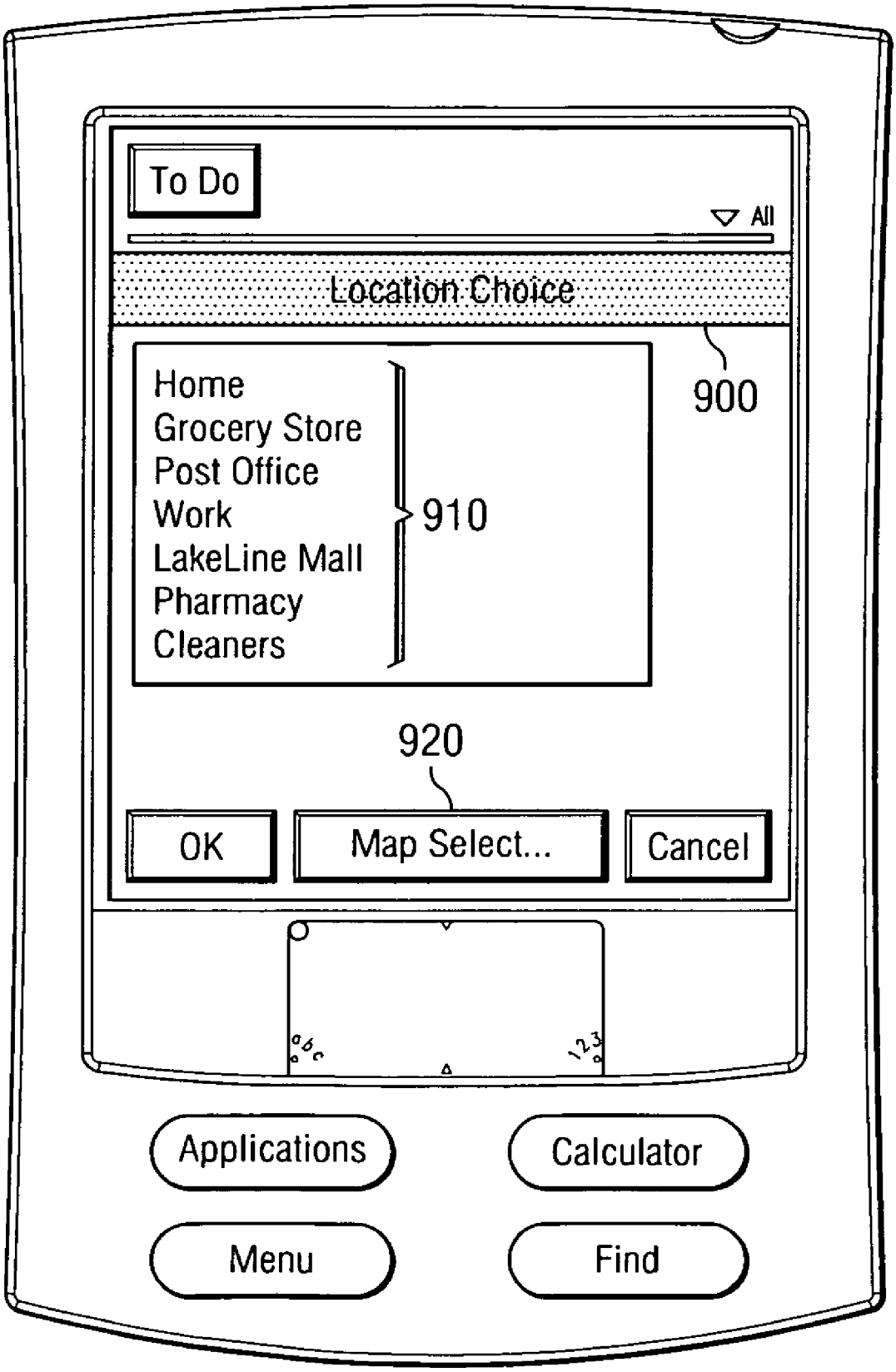
FIG. 9 is another exemplary block diagram illustrating an interface for a mobile computing device when a user selects a location from a saved list of locations in accordance with an exemplary embodiment of the present invention.

FIG. 9 is an exemplary block diagram illustrating an interface for a mobile computing device when a user selects a location from a saved list of locations in accordance with an exemplary embodiment of the present invention. Interface 900 may be displayed on a mobile computing device such as mobile computing device 710 in FIG. 7.

In this illustrative example, interface 900 displays a location selection window where list of geographic locations 910 is presented. List of geographic locations 910 provides a list of saved geographic locations available in a location database, such as location database 750 in FIG. 7.

In this illustrative embodiment of the present invention, list of geographic locations 910 is a scrollable list. However, saved geographic locations stored in a location database on a mobile computing device can be presented to the user in accordance with any known or available methods for presenting selectable options to a user, including, but not limited to a menu, graphical user interface, command-line interface, or any combination of these options.

If a desired location is not available in the list of geographic locations, a user can select a new geographic location utilizing a global positioning system mapping function, as is depicted below in FIG. 10. As illustrated in this example, a user may initiate a global positioning system navigation mapping feature available in global positing system enabled devices by selecting the "Map Select" button 920 on interface 900.

In accordance with this exemplary embodiment of the present invention, after a user has selected a new geographic location utilizing a global positioning system navigation mapping feature, the new geographic location is added to geographic location list 910.

FIG. 10 is an exemplary block diagram illustrating an interface for a mobile computing device when a new geographic location is selected by a user utilizing a navigation mapping feature in accordance with an exemplary embodiment of the present invention. Interface 1000 may be displayed on a mobile computing device such as mobile computing device 710 in FIG. 7.

Interface 1000 displays a navigation map selection feature linked to a task details 1010 field associated with a new task. To set the proximity task-based alarm, the user chooses a location using the navigational mapping 1020 feature to select a new geographic location. For example, if a user enters a new task to buy extra stamps, the user can locate a post office using the global positioning system navigation. The user can choose to receive a reminder to get extra stamps the next time the user is at or near the post office. When the proximity alarm is set, the task-reminder alarm is triggered to generate a task-reminder the next time the user is within the specified distance of the post office.

Figure 11:
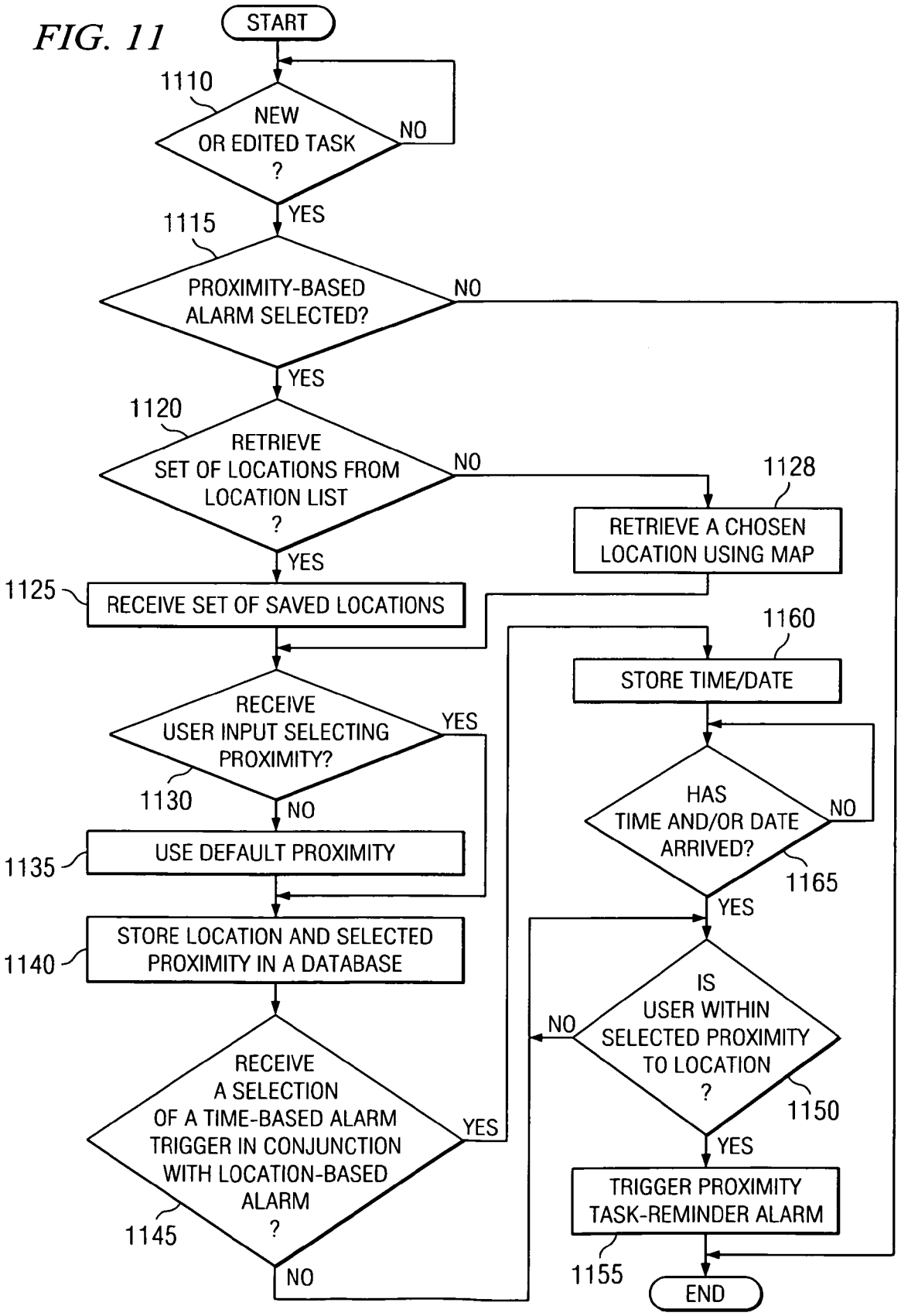
FIG. 11 is a flowchart outlining an exemplary operation of the present invention when a user sets a proximity task-reminder alarm in accordance with an illustrative embodiment of the present invention.

FIG. 11 is a flowchart outlining an exemplary operation of the present invention when a user sets a proximity task-reminder alert in accordance with an illustrative embodiment of the present invention. The process is implemented by a software component, such as task list manager 715 in FIG. 7. Location navigation 760 in FIG. 7 implements steps 1150 and 1155.

The process begins when a task list manager determines whether a new or edited task has been received from a user (step 1110). If no new task or edited task has been received, the process returns to step 1110.

When a new task or an edited task is received by the process from a user, a determination is made as to whether a proximity-based alarm has been selected (step 1115). If a proximity-based alarm has not been selected, the process terminates since no proximity task-reminder alarm is set for this task. If a proximity-based alarm has been selected, a determination is made as to whether a location will be selected from a list of geographic locations (step 1120). If the desired location is presently included in a saved list of geographic locations, the process receives user input choosing a set of one or more saved locations (step 1125). However, if the process does not receive a user input choosing a set of one or more saved locations from a saved list of geographic locations at step 1120, the process receives user input selecting a new location chosen using a global positioning system navigational mapping feature (step 1128). The navigational mapping feature is a feature that permits a user to select a location on a map that is presented to the user on a display.

Once a set of locations has been received from a user input selecting a set of locations from the list of saved locations at step 1125 and/or a new location is received from a user input selecting a new location using a mapping feature at step 1128, the process makes a determination as to whether a selected proximity for the selected location has been entered (step 1130).

If the process determines that a selected proximity has not been entered, the process utilizes a default proximity (step 1135) as the selected proximity. Whether a proximity has been selected at step 1130 or if a default proximity is utilized at step 1135, the process stores the set of locations and the selected proximity for the set of locations in a location database (step 1140).

The process makes a determination as to whether a time-based alarm has been entered in conjunction with the location based alarm (step 1145). If the process has not received a user selection for a time-based alarm trigger in addition to the location based alarm trigger, the process determines whether the user is within the selected proximity of the selected geographic location (step 1150). If the user is not within the selected proximity of the location, the process returns to step 1150. If the user is within the selected proximity of the location, the process triggers a proximity task-reminder alarm (step 1155) with the process terminating thereafter.

Returning now to step 1145, if the process receives a user selection to enter a time-based alarm trigger in conjunction with the location based alarm trigger, the process stores a date and/or time entered by the user in a database in association with the new or edited task (step 1160). The process then determines whether the selected date and/or time has arrived (step 1165). If the selected date and/or time has not arrived, the process returns to step 1165. If the selected time and/or data has arrived, the process determines if the user is within the selected proximity of the geographic location associated with the task (step 1150). If the user is not within the selected proximity, the process returns to step 1150. When the process determines that the user is within the selected proximity, location navigation triggers a proximity task-reminder alarm (step 1155) with the process terminating thereafter.

The aspects of the present invention permit a user to link a geographic location to a task in a task list to create a location based alarm together with and separately from a time-based alarm. A proximity task-reminder alarm is triggered based upon the user's proximity to the geographic location linked to the task.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A computer implemented method for generating proximity-based task alarms in a mobile computing device, the computer implemented method comprising:

receiving a set of tasks from a user, wherein receiving the set of tasks from the user further comprises:

presenting a time-based alarm and a proximity-based task alarm to the user when the user first enters a task from the set of tasks on the mobile computing device, wherein a place button located on a display screen of the mobile computing device is selected by the user to link the set of tasks to one or more geographic locations within a set of geographic locations;

receiving a selection from a user to link the set of tasks to one or more geographic locations within a set of geographic locations, wherein each task within the set of tasks has a unique task identifier associated with that particular task and each geographic location has a unique location identifier associated with that geographic location in a task list manager on the mobile computing device, wherein tasks from the set of tasks can be related or unrelated;

responsive to setting the proximity-based task alarm, receiving a determination whether to associate the each task to a desired location located in a saved list of the set of geographic locations on the mobile computing device or to select a new location;

responsive to a determination to select the new location, selecting the new location using a global positioning system navigational mapping feature, wherein the global positioning system navigational feature permits the user to select the new location on a map presented to the user on the display screen of the mobile computing device;

determining whether a selected proximity for the proximity-based alarm has been selected;

responsive to a determination that the selected proximity has not been selected, utilizing a default proximity as the selected proximity;

determining whether the mobile computing device is within the selected proximity of the location for the each task;

responsive to a determination that the mobile computing device is within the selected proximity of the location for the each task using the global positioning system navigational feature, triggering the proximity-based task alarm; and receiving an indication of completion of the each task by canceling the proximity-based task alarm or by resetting the proximity-based task alarm to receive another proximity-based task alarm when the user is within the selected proximity of at least one of the geographic locations.

2. The computer implemented method of claim 1 wherein the step of determining whether the mobile computing device is within the proximity of the geographic locations is made based upon information provided by a global positioning system receiver.

3. The computer implemented method of claim 1 wherein the proximity-based task alarm is presented as an alarm type selected from the group consisting of a graphic alarm, a sound alarm, a flashing visual alarm, and a vibration alarm.

* * * * *